US012188482B1

(12) United States Patent
Licai et al.

(10) Patent No.: US 12,188,482 B1
(45) Date of Patent: Jan. 7, 2025

(54) STRUCTURE FOR FAST MOUNTING OF CEILING FAN BLADES

(71) Applicant: Zhongshan City Fanyou Electric Science & amp; Technology Co., Ltd, Zhongshan (CN)

(72) Inventors: Zhong Licai, Zhongshan (CN); Yan Shitian, Zhongshan (CN)

(73) Assignee: Zhongshan City Fanyou Electric Science & amp; Technology Co., Ltd

( * ) Notice: Subject to any disclaimer, the term of this patent is extended or adjusted under 35 U.S.C. 154(b) by 0 days.

(21) Appl. No.: 18/655,379

(22) Filed: May 6, 2024

(30) Foreign Application Priority Data

Mar. 14, 2024 (CN) ..... 202420488991.1

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 29/34; F04D 25/088
See application file for complete search history.

(56) References Cited

U.S. PATENT DOCUMENTS 6,059,531 A * 5/2000 Tai ..... F04D 29/34 416/207
6,171,059 B1 * 1/2001 Bucher ..... F04D 29/34 416/207
6,390,777 B1 * 5/2002 Kerr, Jr. ..... F04D 29/34 416/214 R
6,726,453 B1 * 4/2004 Hsieh ..... F04D 25/088 416/207
6,916,156 B2 * 7/2005 Tseng ..... F04D 29/34 403/324
2003/0219340 A1 * 11/2003 Hidalgo ..... F04D 29/34 416/207
2004/0001758 A1 * 1/2004 Liang ..... F04D 29/34 416/220 A
2015/0300364 A1 * 10/2015 Lin ..... F04D 25/088 416/221
2017/0037869 A1 * 2/2017 Zauhar ..... F04D 25/088
2017/0350414 A1 * 12/2017 Wang ..... F04D 25/088

* cited by examiner

*Primary Examiner* — David E Sosnowski
*Assistant Examiner* — Theodore C Ribadeneyra
(74) *Attorney, Agent, or Firm* — Jose Cherson Weissbrot

(57) ABSTRACT

Disclosed is a structure for fast mounting of ceiling fan blades, including a motor fixing base for placing a motor, a plurality of blades, and a blade mounting structure. The blade mounting structure includes a fast self-locking pressuring block, a bolt, and elastic pressuring block reset members, and they are always mounted in the motor fixing base. When mounting a blade, the blade is inserted into the plug-in blade mounting opening and the bolt are tightened, so that the blade locking pin on the fast self-locking pressing block is inserted into the locking pin insertion hole of the blade, to complete the mounting. To dismount the blade, the bolt is loosened until the blade locking pin of the fast self-locking pressing block leaves the locking pin insertion hole of the blade, and the blade is unlocked, so that the blade can be smoothly pulled out and removed.

6 Claims, 4 Drawing Sheets

STRUCTURE FOR FAST MOUNTING OF CEILING FAN BLADES

TECHNICAL FIELD

The present disclosure relates to a ceiling fan, in particular to a structure for fast mounting of ceiling fan blades.

BACKGROUND

We know that a ceiling fan is provided with at least three blades. In conventional circumstances, each blade is fixed on a housing of a motor by means of at least two screws. Before tightening each screw, it is necessary to first align the screw with a screw hole of the blade and a threaded hole of the housing of the motor simultaneously to screw in. It can be seen that this conventional method of mounting ceiling fan blades is cumbersome and inefficient, and it is necessary to make improvements.

SUMMARY

In order to overcome the defects in the prior art, the present disclosure provides a structure for fast mounting of ceiling fan blades, which greatly saves the time of blade mounting and facilitates the assembly and disassembly of blades.

In order to solve the above technical problems, the present disclosure adopts the following technical solution:

A structure for fast mounting of ceiling fan blades, including a motor fixing base for placing a motor, a plurality of blades, and a blade mounting structure, where the blade mounting structure includes a fast self-locking pressuring block, a bolt, and elastic pressuring block reset members:

- the fast self-locking pressing block is arranged in a guide slot of the motor fixing base and is capable of sliding up and down in the guide slot; the fast self-locking pressing block is provided with blade locking pins and threaded holes; after the fast self-locking pressing block is arranged in the guide slot of the motor fixing base, a plug-in blade mounting opening A is formed between the fast self-locking pressing block and the motor fixing base;
- the bolt is inserted into a through hole of the motor fixing base and screwed into the threaded hole of the fast self-locking pressuring block;
- the elastic pressuring block reset member of the pressuring block is arranged in the guide slot of the motor fixing base, so that the fast self-locking pressuring block is capable of tending to slide in the guide slot outwardly to open the plug-in blade mounting opening A; when the plug-in blade mounting opening A is in an opened state, an inner end of the blade can be movably inserted into and pulled out of the plug-in blade mounting opening A; and
- a locking pin insertion hole is formed at the inner end of the blade; when the inner end of the blade is inserted into the plug-in blade mounting opening A, and when the bolt is screwed to narrow the plug-in blade mounting opening A, the blade locking pin can be inserted into the locking pin insertion hole of the blade.

Further, a notch capable of avoiding interference with the bolt is further formed at the inner end of the blade.

Further, a pin hole is formed in the guide slot of the motor fixing base for inserting an end portion of the blade locking pin.

Further, at least two blade locking pins of the fast self-locking pressing block are arranged, and at least two pin holes are formed in the guide slot of the motor fixing base.

Further, the threaded hole of the fast self-locking pressing block can be directly formed in the pressing block, or can be a threaded hole of a nut that is relatively non-rotatably arranged in the fast self-locking pressing block.

Further, two elastic pressuring block reset members are compressed springs, and located at both ends of the fast self-locking pressuring block.

Compared with the prior art, the present disclosure has the beneficial effects as follows: The blade mounting structure includes a fast self-locking pressuring block, a bolt, and elastic pressuring block reset members, and they are always mounted in the motor fixing base. When mounting a blade, the blade is inserted into the plug-in blade mounting opening and the bolt are tightened, so that the blade locking pin on the fast self-locking pressing block is inserted into the locking pin insertion hole of the blade, to complete the mounting. To dismount the blade, the bolt is loosened (without need to completely unscrew) until the blade locking pin of the fast self-locking pressing block leaves the locking pin insertion hole of the blade, and the blade is unlocked, so that the blade can be smoothly pulled out and removed. Therefore, the present disclosure greatly saves the time of blade mounting, and makes the assembly and disassembly of the ceiling fan blades simpler, more convenient and faster.

The present disclosure will be further described in detail with reference to the accompanying drawings and specific embodiments.

DETAILED DESCRIPTIONS OF THE EMBODIMENTS

Figure 1:
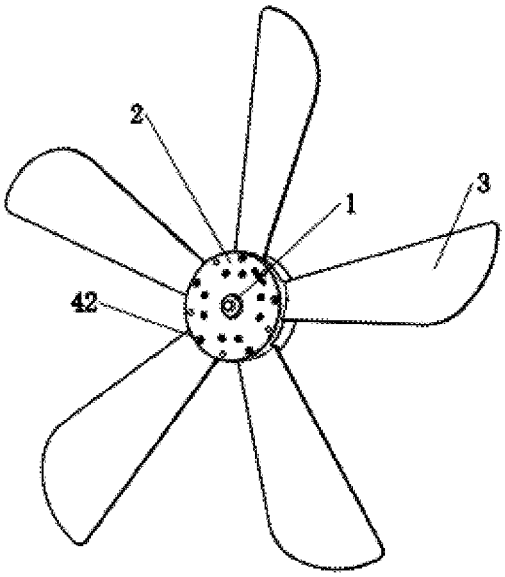
FIG. 1 is a three-dimensional schematic diagram I of an embodiment of the present disclosure.
Figure 2:
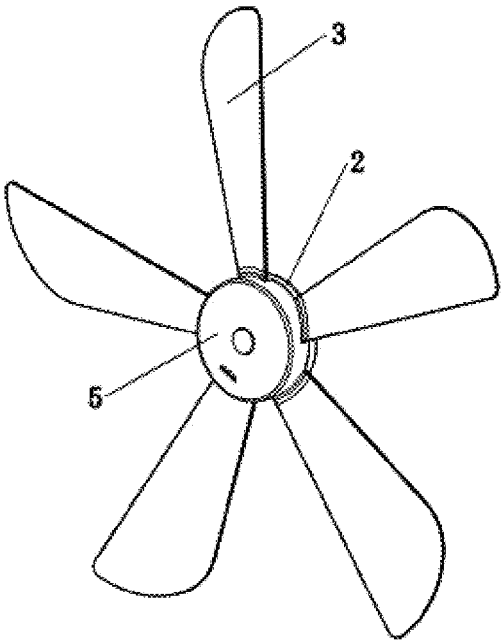
FIG. 2 is a three-dimensional schematic diagram II of an embodiment of the present disclosure.

A structure for fast mounting of ceiling fan blades, as shown in FIGS. 1 to 8, includes a motor fixing base 2 for placing a motor 1, a plurality of blades 3, and a blade mounting structure 4, where the blade mounting structure 4 includes a fast self-locking pressuring block 41, a bolt 42, and elastic pressuring block reset members 43:

- the fast self-locking pressing block 41 is arranged in a guide slot 21 of the motor fixing base 2 and is capable of sliding up and down in the guide slot 21; the fast self-locking pressing block 41 is provided with blade locking pins 411 and threaded holes 412; after the fast self-locking pressing block 41 is arranged in the guide slot 21 of the motor fixing base 2, a plug-in blade mounting opening A is formed between the fast self-locking pressing block 41 and the motor fixing base 2;

the bolt 42 is inserted into a through hole 22 of the motor fixing base 2 and screwed into the threaded hole 412 of the fast self-locking pressuring block 41;

the elastic pressuring block reset member 43 of the pressuring block is arranged in the guide slot 21 of the motor fixing base 2, so that the fast self-locking pressuring block 41 is capable of tending to slide in the guide slot 21 outwardly to open the plug-in blade mounting opening A; when the plug-in blade mounting opening A is in an opened state, an inner end of the blade 3 can be movably inserted into and pulled out of the plug-in blade mounting opening A (that is, in this case, the blade locking pin 411 will not affect the entry and exit of the blade 3 from the plug-in blade mounting opening A); and a locking pin insertion hole 31 is formed at the inner end of the blade 3; when the inner end of the blade 3 is inserted into the plug-in blade mounting opening A, and when the bolt 42 is screwed to narrow the plug-in blade mounting opening A, the blade locking pin 411 can be inserted into the locking pin insertion hole 31 of the blade 3, thereby preventing the blades from falling off when the ceiling fan works. In this embodiment, a notch 32 capable of avoiding interference with the bolt 42 is further formed at the inner end of the blade 3, to prevent affecting the screwing of the bolt and the mounting of the blade in place. Of course, when the bolt is relatively close to the inner end, so that the innermost end of the blade does not touch the bolt and does not affect the mounting of the blade, it is not necessary to open a notch.

Figure 3:
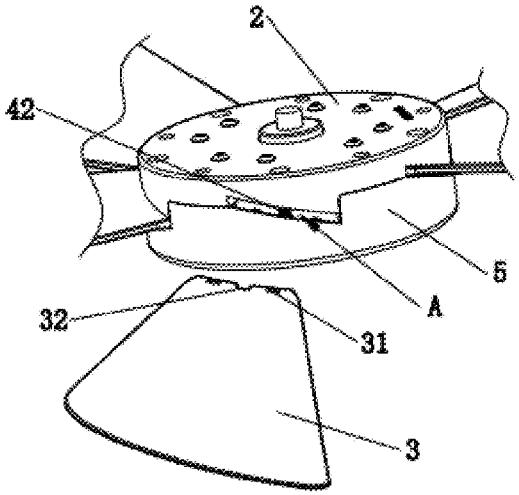
FIG. 3 is a schematic diagram I of disassembly of a blade of an embodiment of the present disclosure.
Figure 4:
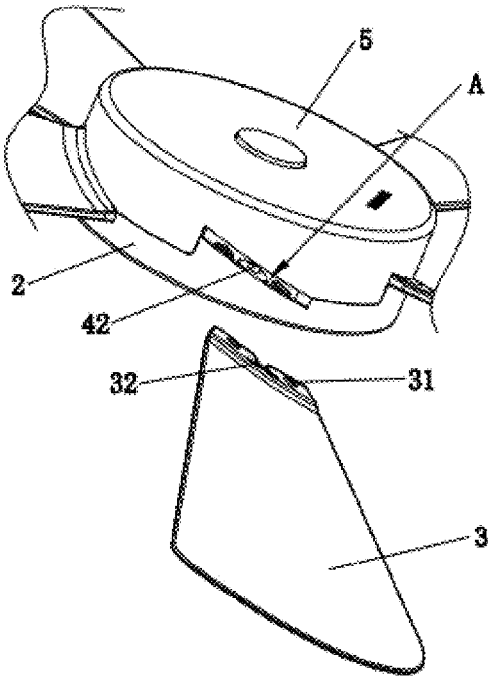
FIG. 4 is a schematic diagram II of disassembly of a blade of an embodiment of the present disclosure.

Normally, when the plug-in blade mounting opening A is in an opened state, the blade locking pin 411 will not be exposed in the plug-in blade mounting opening A, as shown in FIGS. 3 and 4 of this embodiment. Of course, the blade locking pin 411 can also be slightly exposed, but in this case, the head of the blade locking pin 411 should be configured to be of an arc-shaped or semi-circular structure, under the condition that plug-in mounting and pull-out dismounting of the blade 3 are not interfered.

When the ceiling fan of this embodiment is delivered or packaged for transportation, all components of the blade mounting structure 4, including the bolt 42, have been mounted, and only the blades are in a dismounted state. Therefore, when mounting each blade 3, it is only required to align the inner end of the blade 3 with the plug-in blade mounting opening A of the ceiling fan and insert it, and then screw the bolt 42 to enable the fast self-locking pressing block 41 to tighten the mounting opening while compressing it against the blade 3, so that the blade locking pin 411 of the fast self-locking pressing block 41 is inserted into the locking pin insertion hole 31 of the blade 3. In this way, mounting of one of the blades is completed. To dismount the blade 3, the bolt 42 is loosened, and the fast self-locking pressing block 41, under the action of the elastic pressuring block reset member 43, is no longer compressed on the blade. When the blade locking pin 411 of the fast self-locking pressing block 41 leaves the locking pin insertion hole 31 of the blade 3, the blade is unlocked, so that the blade 3 can be smoothly pulled out and removed. It can be seen from the above that the assembly and disassembly of the ceiling fan blades of the present disclosure are simpler, more convenient and faster.

In this embodiment, a pin hole 23 is formed in the guide slot 21 of the motor fixing base 2 for inserting an end portion of the blade locking pin 411. When the blade 3 is mounted and fixed, the end portion of the blade locking pin 411 is inserted into the pin hole 23, so that mounting of the blade 3 is firmer, thereby making the use of the ceiling fan safer.

Figure 5:
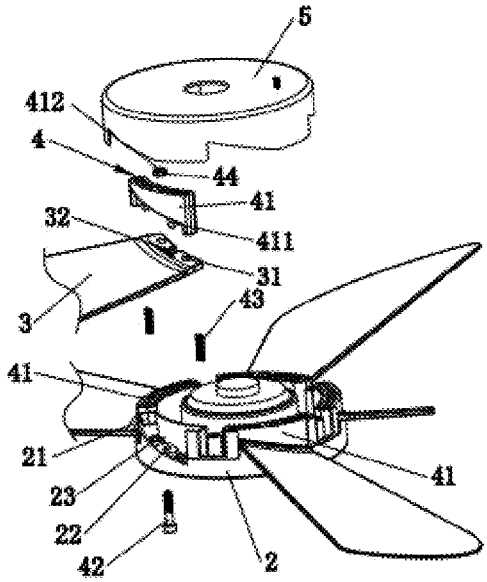
FIG. 5 is a schematic diagram I of assembly of some components of an embodiment of the present disclosure.
Figure 6:
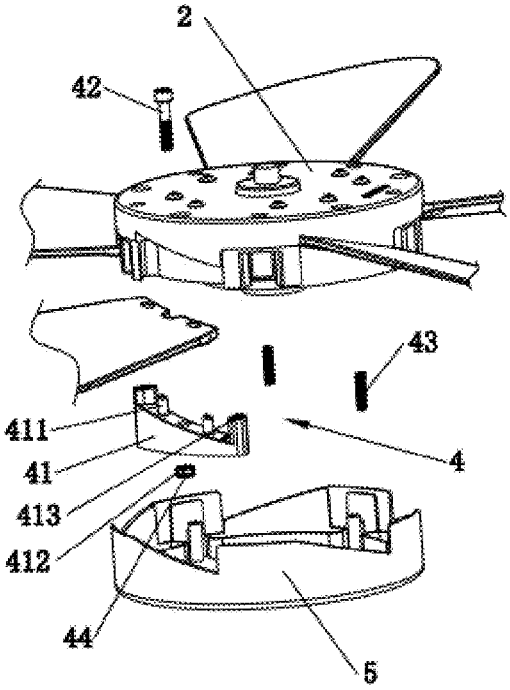
FIG. 6 is a schematic diagram II of assembly of some components of an embodiment of the present disclosure.
Figure 7:
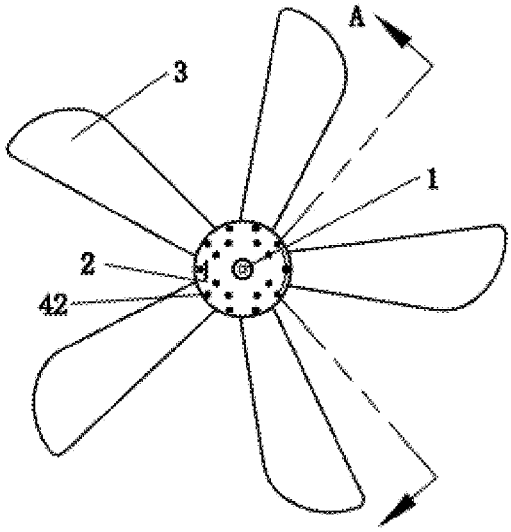
FIG. 7 is a top view of FIG. 1.
Figure 8:
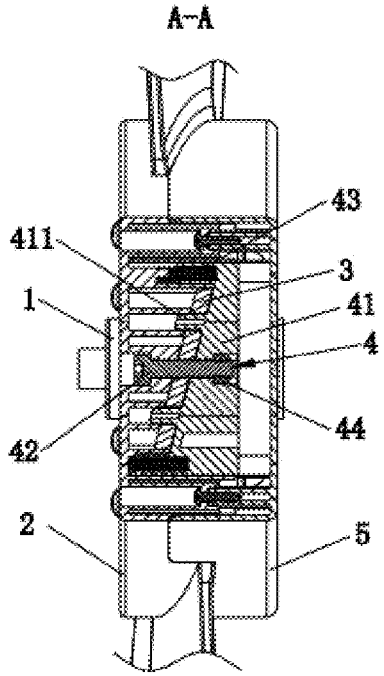
FIG. 8 is a sectional view of FIG. 7 in an A-A direction.

The threaded hole 412 of the fast self-locking pressing block 41 can be directly formed in the pressing block (for example, a threaded hole can be generated by directly tapping in a corresponding hole of the self-locking pressing block), or can be a threaded hole of a nut 44 that is relatively non-rotatably arranged in the fast self-locking pressing block 41, as shown in this embodiment (FIGS. 5 and 6). Preferably, at least two (usually preferably 2 to 3) blade locking pins 411 of the fast self-locking pressing block are arranged, to ensure the firm mounting of the blades and the safe use of the ceiling fan; and in this case, correspondingly, at least two pin holes 23 are formed in the guide slot 21 of the motor fixing base 2.

In this embodiment, the motor fixing base 2 is provided with a decorative cover 5 that is capable of covering the motor fixing base 2, the motor 1, and outer ends of lower surfaces of root portions of the blades 3 simultaneously, and the decorative cover 5 is fixedly connected to the motor fixing base 2 (fixed by screws herein).

In this embodiment, two elastic pressuring block reset members 43 are compressed springs, and located at both ends of the fast self-locking pressuring block 41, so that the fast self-locking pressuring block is stressed more evenly, thus facilitating smooth assembly and disassembly of the blades. To facilitate the placement and positioning of the compressed springs, compressed spring mounting holes 413 are formed on the fast self-locking pressuring block 41. Of course, the elastic pressuring block reset members can also be elastic members such as tension springs.

In the description of the present disclosure, it is to be understood that the terms "central", "longitudinal", "transverse", "upper", "lower", "front", "rear", "left", "right", "vertical", "horizontal", "top", "bottom", "inside", and "outside", etc. indicate azimuthal or positional relations based on those shown in the drawings or reference azimuthal relations based on directions of product mounting and use shown in the drawings only for ease of description of the present disclosure and for simplicity of description, and are not intended to indicate or imply that the referenced device or element must have a particular orientation and be constructed and operative in a particular orientation, and thus may not be construed as a limitation on the present disclosure.

The above descriptions are merely preferred embodiments of the present disclosure, and are not intended to limit the scope of protection of the present disclosure, that is, all equivalent changes and modifications made within the scope of claims of the present disclosure shall fall within the technical scope of the present disclosure.

What it claimed is:

1. A structure for fast mounting of ceiling fan blades, comprising a motor fixing base for placing a motor, a plurality of blades, and a blade mounting structure, wherein the blade mounting structure comprises a fast self-locking pressuring block, a bolt, and elastic pressuring block reset members:

the fast self-locking pressuring block is arranged in a guide slot of the motor fixing base and is capable of sliding up and down in the guide slot; the fast self-locking pressuring block is provided with blade locking pins and threaded holes; after the fast self-locking pressuring block is arranged in the guide slot of the motor fixing base, a plug-in blade mounting opening is formed between the fast self-locking pressing block and the motor fixing base;

the bolt is inserted into a through hole of the motor fixing base and screwed into one of the threaded holes of the fast self-locking pressuring block;

the elastic pressuring block reset member of the pressuring block is arranged in the guide slot of the motor fixing base, so that the fast self-locking pressuring block is capable of tending to slide in the guide slot outwardly to open the plug-in blade mounting opening; when the plug-in blade mounting opening is in an opened state, an inner end of the blade can be movably inserted into and pulled out of the plug-in blade mounting opening; and a locking pin insertion hole is formed at the inner end of the blade; when the inner end of the blade is inserted into the plug-in blade mounting opening, and when the bolt is screwed to narrow the plug-in blade mounting opening, one of the blade locking pins can be inserted into the locking pin insertion hole of the blade.

2. The structure for fast mounting of ceiling fan blades according to claim 1, wherein a notch capable of avoiding interference with the bolt is further formed at the inner end of the blade.

3. The structure for fast mounting of ceiling fan blades according to claim 1, wherein a pin hole is formed in the guide slot of the motor fixing base for inserting an end portion of one of the blade locking pins.

4. The structure for fast mounting of ceiling fan blades according to claim 3, wherein at least two blade locking pins of the fast self-locking pressuring block are arranged, and at least two pin holes are formed in the guide slot of the motor fixing base.

5. The structure for fast mounting of ceiling fan blades according to claim 1, wherein one of the threaded holes of the fast self-locking pressuring block can be directly formed in the pressuring block, or can be a threaded hole of a nut that is relatively non-rotatably arranged in the fast self-locking pressuring block.

6. The structure for fast mounting of ceiling fan blades according to claim 1, wherein two elastic pressuring block reset members are compressed springs, and are located at both ends of the fast self-locking pressuring block.

* * * * *